US008928250B2

(12) United States Patent
Mays, II et al.

(10) Patent No.: US 8,928,250 B2
(45) Date of Patent: Jan. 6, 2015

(54) METHOD AND CIRCUIT FOR LED LOAD MANAGMENT

(71) Applicant: Universal Lighting Technologies, Inc., Madison, AL (US)

(72) Inventors: Stephen D. Mays, II, Madison, AL (US); John J. Dernovsek, Madison, AL (US)

(73) Assignee: Universal Lighting Technologies, Madison, AL (US)

( * ) Notice: Subject to any disclaimer, the term of this patent is extended or adjusted under 35 U.S.C. 154(b) by 0 days.

(21) Appl. No.: 14/031,469

(22) Filed: Sep. 19, 2013

(65) Prior Publication Data

US 2014/0077702 A1 Mar. 20, 2014

Related U.S. Application Data

(60) Provisional application No. 61/702,835, filed on Sep. 19, 2012.

(51) Int. Cl.
*H05B 37/02* (2006.01)
*H05B 33/08* (2006.01)

(52) U.S. Cl.
CPC ..... *H05B 33/0809* (2013.01); *H05B 33/0851* (2013.01)
USPC ..... 315/291; 315/308

(58) Field of Classification Search
USPC ..... 315/185 R, 209 R, 291, 307, 308
See application file for complete search history.

(56) References Cited

U.S. PATENT DOCUMENTS 8,487,546 B2 * 7/2013 Melanson ..... 315/291
8,581,518 B2 * 11/2013 Kuang et al. ..... 315/307

* cited by examiner

*Primary Examiner* — Jimmy Vu
(74) *Attorney, Agent, or Firm* — Waddey Patterson; Mark J. Patterson; Mark A. Pitchford

(57) ABSTRACT

A light fixture includes a driver circuit that fully defines operational characteristics for operation outside of "Nominal Operation" of the driver circuit. The driver circuit increases a target current or set point when the current of the light source (i.e., output current of the driver circuit) or the voltage of the light source (i.e., output voltage of the driver circuit) is below a minimum operating current or minimum operating voltage of the driver circuit regardless of a command current level of the driver circuit. The driver circuit implements a soft start ramp up scheme having a default rate of increase for a set point or target current. After a shutdown, the driver circuit periodically attempts to restart operation by increasing the set point or target current from zero (i.e., shutdown) at a reduced rate as compared to the default rate.

20 Claims, 4 Drawing Sheets

METHOD AND CIRCUIT FOR LED LOAD MANAGMENT

CROSS-REFERENCES TO RELATED APPLICATIONS

This application claims priority to and incorporates by reference in its entirety U.S. Provisional Patent Application Ser. No. 61/702,835 entitled "METHOD AND CIRCUIT FOR LED LOAD MANAGEMENT" filed on Sep. 19, 2012.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to constant current driver circuits. More particularly, this invention pertains to constant current direct current (DC) driver circuits for providing power for light emitting diode (LED) light sources.

LED driver circuits limit the maximum voltage developed across an LED load by reducing the driven current. Referring to prior art FIG. 1, a maximum operating voltage, "Vnominal" 102, and maximum operating current, "Ibright" 104, are defined. If the magnitude of the current reaches a shutdown current threshold, "Ishutdown" 106, or a shutdown voltage threshold, "Vshutdown" 108, the driver circuit shuts down to protect itself. A driver circuit with a fast control loop attempting to start an abnormally high impedance load (i.e., light source such as an LED) will likely shut down. Shutting down commonly requires cycling of a power source powering the driver circuit (e.g., turning a light switch off and back on) to restart the driver circuit. Not all driver circuits are designed to shut down when unloaded (i.e., when the voltage is above the nominal or maximum operating voltage 102 and even above the shutdown voltage 108) and will, therefore, maintain a high and unsafe output voltage. When an LED load is reattached to a driver circuit that is generating an abnormally high output voltage, the LED load experiences high surge currents which can instantly and permanently damage the LEDs. While these behaviors protect the driver circuit from excessive component stress and damage, they can damage the load (e.g., LED light source), and the behavior of the driver circuit is not defined for a voltage below a minimum operating voltage, "Vmin" 110, or a voltage below a minimum operating current, "Imin" 112.

Driver circuits are designed to safely function within the intended range of operation indicated on FIG. 1 as Nominal Operation 120 bounded by the minimum and maximum operating voltages and minimum and maximum operating currents. Functioning outside of nominal operation can damage power transfer components of the driver circuit or cause the load to operate in an unstable manner. One common approach to deal with possibly operating outside of Nominal Operation 120 (i.e., below the minimum operating current 112 and/or below the minimum operating voltage 110) is to shut down the driver circuit and cease to provide power to the load (i.e., the LED light source ceases to provide light).

BRIEF SUMMARY OF THE INVENTION

Aspects of the present invention provide a driver circuit that fully defines operational characteristics for operation outside of Nominal Operation. The driver circuit increases a target current or set point when the current of the light source (i.e., output current of the driver circuit) or the voltage of the light source (i.e., output voltage of the driver circuit) is below a minimum operating current or minimum operating voltage of the driver circuit regardless of a command current level of the driver circuit. The driver circuit implements a soft start ramp-up scheme having a default rate of increase for a set point or target current. After a shutdown, the driver circuit periodically attempts to restart operation by increasing the set point or target current from zero (i.e., shutdown) at a reduced rate as compared to the default rate.

In one aspect, a driver circuit receives power from a power source and provides power to a light source. The driver circuit includes a power converter and a controller. The power converter receives power from the power source and provides power to the light source as a function of a drive signal. The controller senses current to the light source and a voltage of the light source. The controller determines a command current for the current of the light source. The command current is one of either a default current or a current indicated by the dimming circuit of the driver circuit. The controller determines a target current for the current to the light source as a function of the command current, the sense current of the light source, and the sensed voltage of the light source. The controller further provides the drive signal to the power converter as a function of the determined target current.

In another aspect, a light fixture receives power from a power source and provides illumination. The light fixture includes a light source, a driver circuit, and a housing. The light source provides illumination in response to receiving power. The driver receives power from a power source and provides power to a light source. The driver circuit includes a power converter and a controller. The power converter receives power from the power source and provides power to the light source as a function of a drive signal. The controller senses current to the light source and a voltage of the light source. The controller determines a command current for the current of the light source. The command current is one of either a default current or a current indicated by the dimming circuit of the driver circuit. The controller determines a target current for the current to the light source as a function of the command current, the sense current of the light source, and the sensed voltage of the light source. The controller further provides the drive signal to the power converter as a function of the determined target current. The housing supports the light source and the driver circuit.

In another aspect, a method of providing power to a light source via a driver circuit begins with receiving power at a power converter of the drive circuit. The power converter provides power to the light source as a function of a drive signal received at the power converter. A controller of the driver circuit senses a current of the light source and a voltage of the light source. The controller determines a command current for the current of the light source. The command current is one of either a default current or a current indicated by dimming circuit of the driver circuit. The controller determines a target current for the current the light source as a function of the command current, the sensed current to the light source, and the sensed voltage of the light source. The controller provides the drive signal to the power converter as a function of the determined target current.

DETAILED DESCRIPTION OF THE INVENTION

Figure 1:
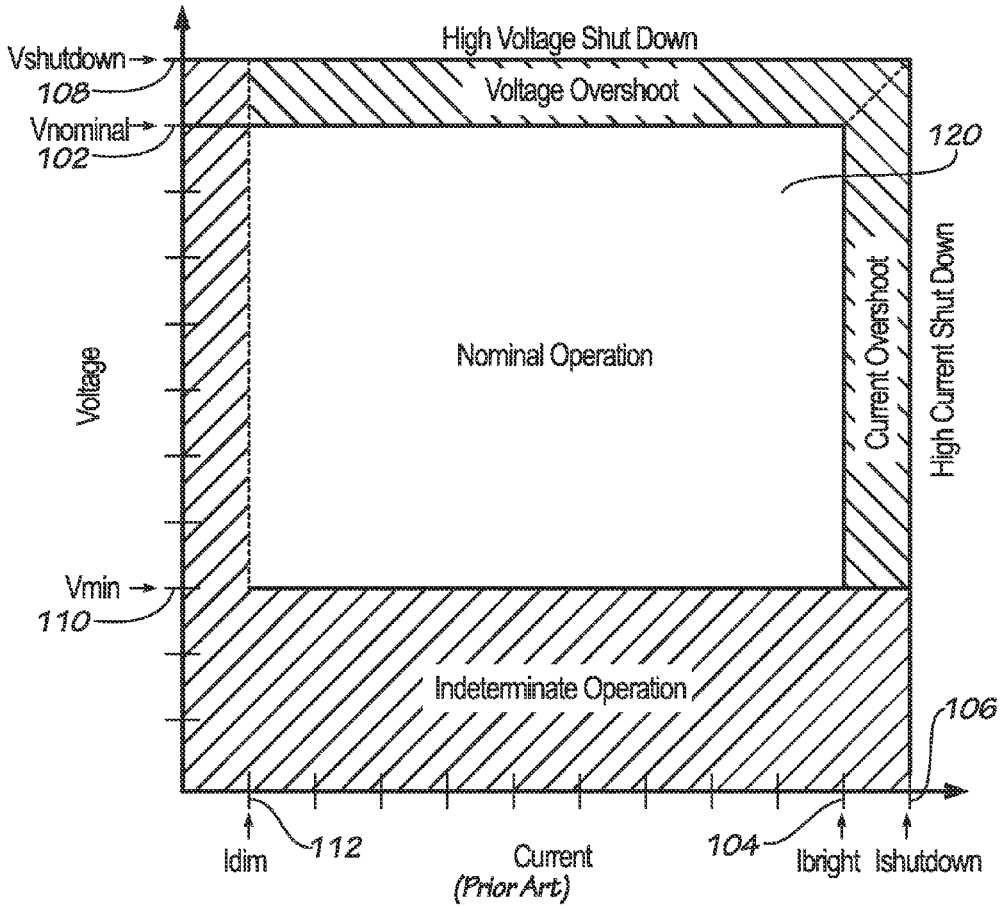
FIG. 1 is a graph of operational regions for a prior art driver circuit.

Reference will now be made in detail to optional embodiments of the invention, examples of which are illustrated in accompanying drawings. Whenever possible, the same reference numbers are used in the drawing and in the description referring to the same or like parts.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As used herein, "ballast" and "driver circuit" refer to any circuit for providing power (e.g., current) from a power source to a light source. Additionally, "light source" refers to one or more light emitting devices such as fluorescent lamps, high intensity discharge lamps, incandescent bulbs, and solid state light-emitting elements such as light emitting diodes (LEDs), organic light emitting diodes (OLEDs), and plasmaloids.

Figure 2:
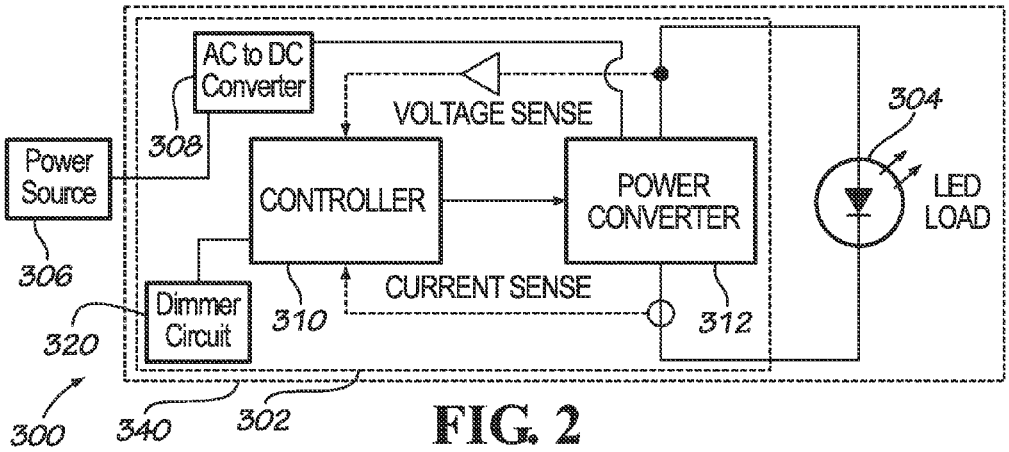
FIG. 2 is a block diagram of a light fixture according to one aspect of the present invention.
Figure 3:
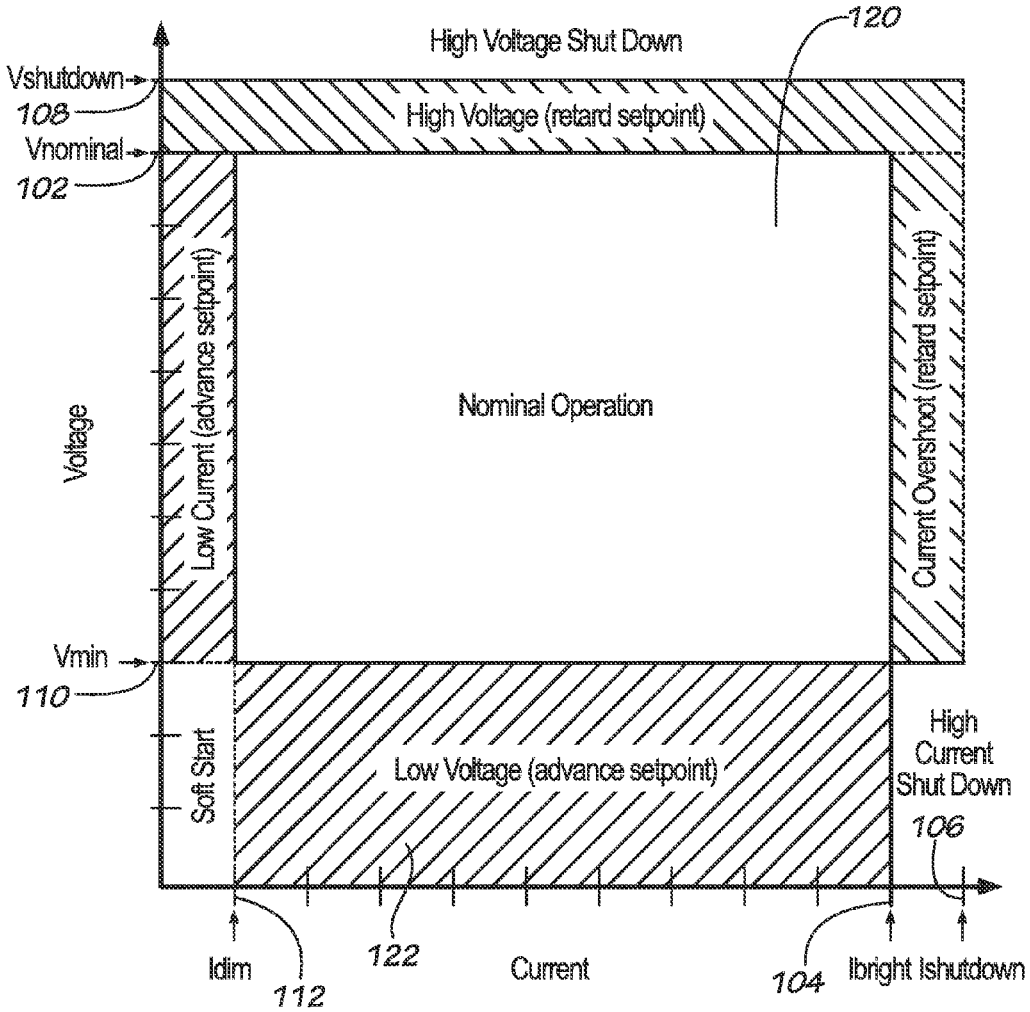
FIG. 3 is a graph of operational regions for one embodiment of a driver circuit according to the present invention.
Figure 4:
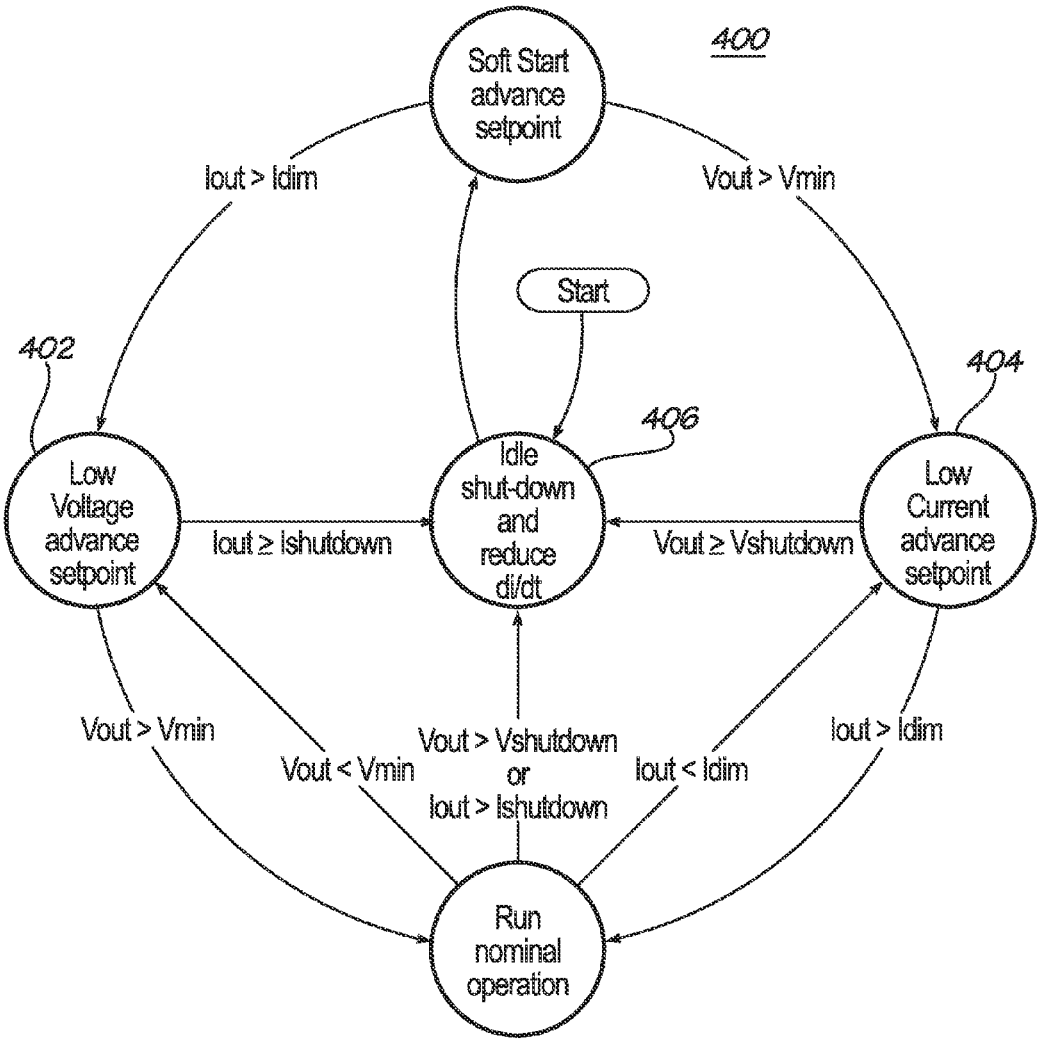
FIG. 4 is a flow chart of a method of providing power from a power source to a light source via a driver circuit, according to an embodiment of the present invention.

Referring to FIGS. 2-4, a light fixture 300 including a driver circuit 302, housing 340, and a light source 304 receives power from a power source 306 and provides illumination. In one embodiment, the power source 306 is an AC power line (e.g., 115 V at 60 Hz). The driver circuit 302 includes an AC-to-DC converter 308 for converting the AC power from the AC power line 306 to DC power. The light source 304 provides light in response to receiving power from the driver circuit 302. In one embodiment, the light source 304 includes a plurality of series connected LEDs. The housing 340 supports the driver circuit 302 and the light source 304. In one embodiment, the housing 340 further includes a light diffuser or reflector configured to create a desired light pattern from light given off by the light source 304.

The driver circuit 302 receives power from the power source 306 (e.g., via the AC-to-DC converter 308) and provides power to the light source 304. The driver circuit 302 includes a controller 310 and a power converter 312. In one embodiment, the power converter 312 is a DC-to-DC converter such as a buck boost converter. The power converter 312 receives power from the power source 306 and provides power to the light source as a function of the drive signal. The controller 310 provides the drive signal as a function of a number of conditions as described below.

The controller 310 senses current to the light source 304 and a voltage of the light source 304. The voltage of the light source 304 and the current to the light source 304 are synonymous with the output voltage and output current of the driver circuit 302. The controller 310 determines a command current for the current of the light source 304. The command current is either a default current or a current level indicated by a dimming circuit 320 of the driver circuit 302. The dimming circuit 320 receives the dimming signal and provides a dimming level to the controller 310. If the controller 310 is not receiving the dimming signal, then the controller 310 determines the command current to be the default current. In one embodiment, the default current is the maximum operational current of the driver circuit Ibright 104 (i.e., full light output of the light source 304). When the controller 310 receives or is receiving the dimming level from the dimming circuit 320, the controller 310 determines the command current as a function of the dimming level. The controller 310 determines a target current for the current of the light source 304 as a function of the command current, the sensed current of the light source 304, and the sensed voltage of the light source 304. The controller 310 provides the drive signal to the power converter 312 as a function of the determined target current.

In operation, the controller 310 increases the target current from zero toward the command current at a default rate of increase. That is, the controller 310 soft starts the power converter 312. As used herein, the target current and a duty cycle of the drive signal may be considered interchangeable as they perform the same function of controlling or regulating power output of the power converter 312. In one embodiment, the drive signal is a pulse width modulated (PWM) gate drive signal such that a duty cycle of the drive signal is proportional to the target current.

During normal operation, the controller 310 increases the target current to the command current at the default rate of increase, and the voltage and current of the light source 304 (i.e., the output voltage and output current of the power converter 312) when the target current reaches the command current are within the nominal operation range 120. That is, the sensed voltage is between the minimum operational voltage 110 in the maximum operational voltage 102, and the sensed current is between the minimum operational current 112 and the maximum operational current 104. During intermediate operation 122, the controller 310 senses that the current to the light source 304 is equal to the command current, but the sensed voltage of the light source 304 is below the minimum voltage of the driver circuit 110. In response, the controller 310 incrementally increases the target current above the command current until the sensed voltage of the light source 304 is above the minimum voltage 110 of the driver circuit 302 or the sensed current of the light source 304 reaches the maximum current 104 of the driver circuit 302.

There are a number of fault conditions that cause the controller 310 to reduce the target current to zero (i.e., shutting down the power converter 312). In a first fault condition, the controller 310 determines that the target current is equal to the maximum current 104 of the driver circuit 302 and the voltage of the light source 304 is below the minimum voltage 110 of the driver circuit 302. In a second fault condition, the controller 310 senses that the current of the light source 304 is at the maximum current 104 of the driver circuit 302 while the sensed voltage of the light source 304 is below the minimum voltage 110 of the driver circuit 302. In a third fault condition, the driver circuit senses that the current of the light source 304 is at or above a shutdown current 106 of the driver circuit 304. In a fourth fault condition, the controller senses that the voltage of the light source 304 is at or above a shutdown voltage 108 of the driver circuit 302. In response to determining a fault condition, the controller 310 is configured to reduce the target current to zero. After reducing the target current to zero in response to determining a fault condition, the controller 310 periodically increases the target current toward the command current at a reduced rate of increase (i.e., rate of increase less than the default rate of increase), reducing the target current back to zero when the same fault condition or another fault condition is detected.

Referring to FIG. 4, a method 400 of providing power to the light source 304 via the driver circuit 302 is illustrated. The method 400 is executed by the controller 312 as described above. The method 400 includes advancing the set point or target current at 402 when the output current "Iout" (i.e., the sensed current of the light source 304) is greater than the minimum operational current "Idim" 112 and the output voltage "Vout" (i.e., the sensed voltage of the light source 304) is less than the minimum operational voltage "Vmin" 110. The method further includes advancing the set point at 404 when the output voltage "Vout" is greater than the minimum operational voltage "Vmin" 110 and the output current "Iout" is less than the minimum operational current "Idim" 112. Additionally, at 406 after any of the fault conditions described above arise, the controller 310 idles the power converter 312 and reduces the rate of increase of the target current or setpoint for subsequent soft start attempts.

Figure 5:
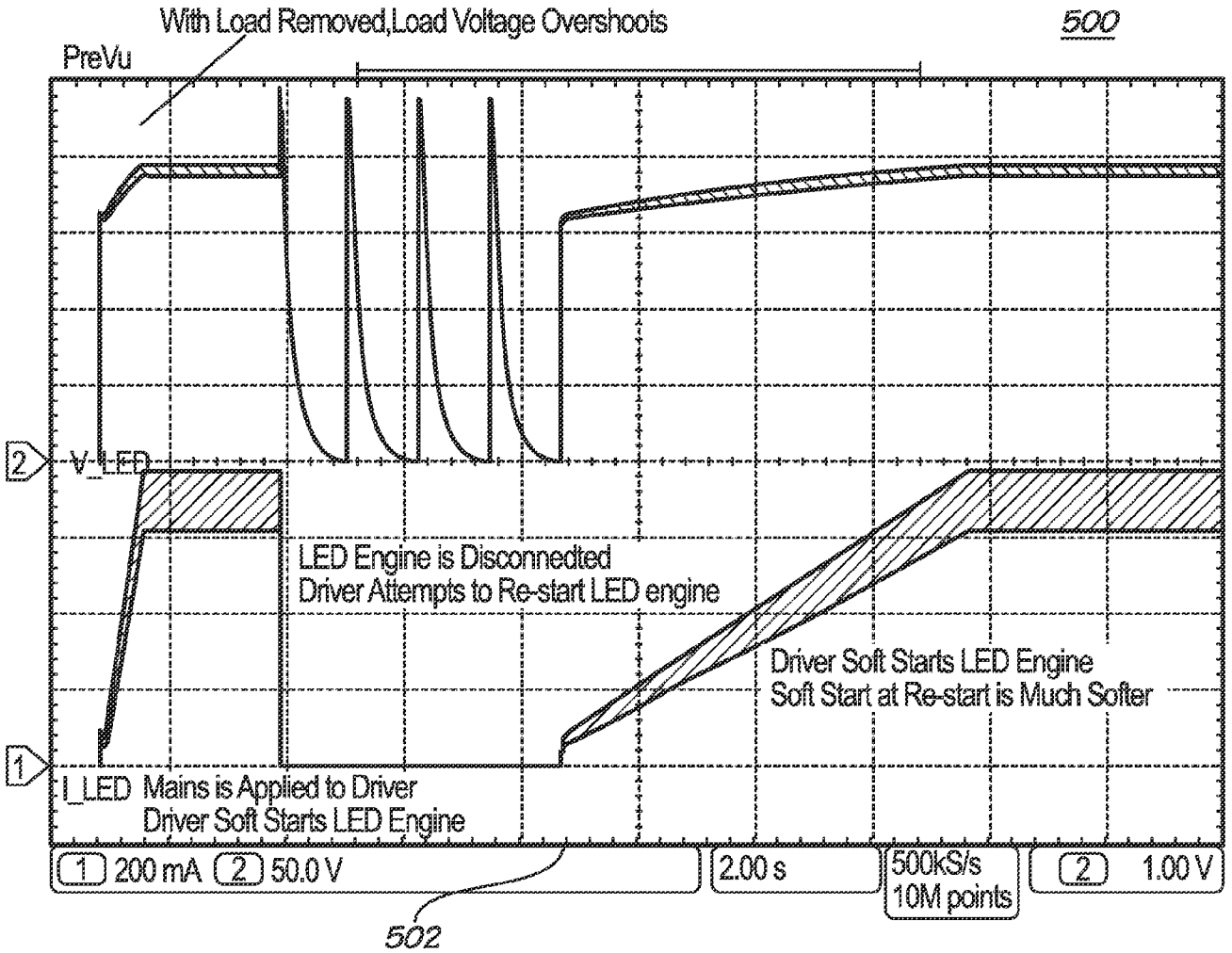
FIG. 5 is an oscilloscope plot of output current and voltage of an exemplary embodiment of a driver circuit under various conditions according to the present invention.

Referring to FIG. 5, an oscilloscope trace 500 of operation of the driver circuit 302 is shown under various conditions. As indicated at the far left of the oscilloscope trace 500, power is applied to the driver circuit 302 and within 800 mSec the load reaches the command current, which in this example, is full load current Ibright 104. At two and a half seconds, the load (i.e., light source 304) is removed and the output voltage or sensed voltage of the light source reaches the shutdown voltage Vshutdown 108 at which point the controller 310 shuts down the driver circuit 312 and the output voltage of the power converter 312 decays to zero volts. At approximately one second intervals, the driver circuit 302 attempts to re-start the LEDs 304 and, because the load (i.e., the LEDs 304) is not connected, the output voltage overshoots to the shutdown voltage Vshutdown 108 and the power converter 312 is again turned off. When the load 304 is finally reapplied at 502, the driver circuit 302 slowly increases the set point from zero amperes (i.e, zero percent duty cycle) to Ibright 104 over a seven second period. The exact times, one second and seven seconds, are arbitrary. The selected exemplary times was to give the light fixture 300 a relatively long period of time to protect itself and still deliver light.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, processor, computing device, client computing device or computer, such as described herein, includes at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media. As used herein, server is not intended to refer to a single computer or computing device. In implementation, a server will generally include an edge server, a plurality of data servers, a storage database (e.g., a large scale RAID array), and various networking components. It is contemplated that these devices or functions may also be implemented in virtual machines and spread across multiple physical computing devices.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful METHOD AND CIRCUIT FOR LED LOAD MANAGEMENT it is not intended that such references be construed as limitations upon the scope of this invention except as set forth in the following claims.

What is claimed is:

1. A driver circuit operable to receive power from a power source and provide power to a light source, said driver circuit comprising:

a power converter operable to receive power from the power source and provide power to the light source as a function of a drive signal; and a controller operable to sense a current of the light source, sense a voltage of the light source, determine a command current for the current of the light source, wherein the command current is one of a default current or a current indicated by a dimming circuit of the driver circuit, determine a target current for the current of the light source as a function of the command current, the sensed current of the light source, and the sensed voltage of the light source, and provide the drive signal to the power converter as a function of the determined target current.

2. The driver circuit of claim 1, wherein the controller is operable to determine the target current by increasing the target current from zero to the command current at a default rate of increase.

3. The driver circuit of claim 1, further comprising a dimming circuit, wherein the dimming circuit is operable to receive a dimming signal and provide a dimming level to the controller, and wherein the controller is further operable to receive the dimming level and determine the command current for the light source by:

determining the command current to be the default current when the controller is not receiving a dimming level from the dimming circuit; and determining the command current to be a current corresponding to the dimming level when the controller is receiving a dimming level from the dimming circuit.

4. The driver circuit of claim 1, wherein the controller is operable to determine the target current by:

determining when the sensed current of the light source is equal to the command current and the sensed voltage of the light source is below a minimum voltage of the driver circuit; and incrementally increasing the target current above the command current in response to determining that the sensed current of the light source is equal to the target current and that the sensed voltage of the light source is below a minimum voltage of the driver circuit until the sensed voltage of the light source is more than the minimum voltage of the driver circuit or the sensed current of the light source reaches a maximum current of the driver circuit.

5. The driver circuit of claim 1, wherein the controller is operable to determine the target current by determining when the sensed current of the light source is equal to the target current and the sensed voltage of the light source is below a minimum voltage of the driver circuit, and increasing the target current above the command current in response to determining that the sensed current of the light source is equal to the target current and that the sensed voltage of the light source is below a minimum voltage of the driver circuit; and the controller is further operable to determine when the target current is equal to a maximum current of the driver circuit and the voltage of the light source is below a minimum voltage of the driver circuit, and reduce the target current to zero in response to determining that the target current is equal to a maximum current of the driver circuit and the voltage of the light source is below a minimum voltage of the driver circuit.

6. The driver circuit of claim 1, wherein the controller is further operable to determine a fault condition as a function of the sensed voltage of the light source and the sensed current of the light source, wherein the fault condition is one of:

the sensed current of the light source is below a minimum current of the driver circuit and the voltage of the light source is at a maximum voltage of the driver circuit;

the sensed current of the light source is at a maximum current of the driver circuit and the sensed voltage of the light source is below a minimum voltage of the driver circuit;

the sensed current of the light source is at or above a shutdown current of the driver circuit; or the sensed voltage of the light source is at or above a shutdown voltage of the driver circuit; and the controller is further operable to reduce the target current to zero in response to determining the fault condition, and after reducing the target current to zero in response to determining the fault condition, periodically increase the target current toward the command current at a reduced rate of increase, reducing the target current back to zero when a fault condition is detected.

7. The driver circuit of claim 1, further comprising an alternating current (AC) to direct current (DC) power converter operable to receive AC power from the power source and provide DC power to the power converter and the controller, wherein the power converter is a direct current (DC) to DC power converter and the drive signal is a pulse width modulated gate drive signal such that a duty cycle of the drive signal is proportion to the target current.

8. A light fixture operable to receive power from a power source and provide light, said light fixture comprising:

a light source operable to provide light in response to receiving power;

a driver circuit operable to receive the power from the power source and provide power to a light source, said driver circuit comprising a power converter operable to receive power from the power source and provide power to the light source as a function of a drive signal, and a controller operable to sense a current of the light source, sense a voltage of the light source, determine a command current for the current of the light source, wherein the command current is one of a default current or a current indicated by a dimming circuit of the driver circuit, determine a target current for the current of the light source as a function of the command current, the sensed current of the light source, and the sensed voltage of the light source, and provide the drive signal to the power converter as a function of the determined target current; and a housing configured to support the light source and the driver circuit.

9. The light fixture of claim 8, wherein the controller is operable to determine the target current by increasing the target current from zero to the command current at a default rate of increase.

10. The light fixture of claim 8, further comprising a dimming circuit, wherein the dimming circuit is operable to receive a dimming signal and provide a dimming level to the controller, and wherein the controller is further operable to receive the dimming level and determine the command current for the light source by: determining the command current to be the default current when the controller is not receiving a dimming level from the dimming circuit; and determining the command current to be a current corresponding to the dimming level when the controller is receiving a dimming level from the dimming circuit.

11. The light fixture of claim 8, wherein controller is further operable to determine the target current by:

determining when the sensed current of the light source is equal to the command current and the sensed voltage of the light source is below a minimum voltage of the driver circuit; and incrementally increasing the target current above the command current in response to determining that the sensed current of the light source is equal to the target current and that the sensed voltage of the light source is below a minimum voltage of the driver circuit until the sensed voltage of the light source is above the minimum voltage of the driver circuit or the sensed current of the light source reaches a maximum current of the driver circuit.

12. The light fixture of claim 8, wherein:

the controller is further operable to determine the target current by determining when the sensed current of the light source is equal to the target current and the sensed voltage of the light source is below a minimum voltage of the driver circuit, and increasing the target current above the command current in response to determining that the sensed current of the light source is equal to the target current and that the sensed voltage of the light source is below a minimum voltage of the driver circuit; and the controller is further operable to determine when the target current is equal to a maximum current of the driver circuit and the voltage of the light source is below a minimum voltage of the driver circuit; and reduce the target current to zero in response to determining that the target current is equal to a maximum current of the driver circuit and the voltage of the light source is below a minimum voltage of the driver circuit.

13. The light fixture of claim 8, wherein the controller is further operable to determine a fault condition as a function of the sensed voltage of the light source and the sensed current of the light source, wherein the fault condition is one of:

the sensed current of the light source is below a minimum current of the driver circuit and the voltage of the light source is at a maximum voltage of the driver circuit;

the sensed current of the light source is at a maximum current of the driver circuit and the sensed voltage of the light source is below a minimum voltage of the driver circuit;

the sensed current of the light source is at or above a shutdown current of the driver circuit; or the sensed voltage of the light source is at or above a shutdown voltage of the driver circuit; and the controller is further operable to reduce the target current to zero in response to determining the fault condition; and after reducing the target current to zero in response to determining the fault condition, periodically increase the target current toward the command current at a reduced rate of increase, reducing the target current back to zero when a fault condition is detected.

14. The light fixture of claim 8, wherein the driver circuit further comprises an alternating current (AC) to direct current (DC) power converter operable to receive AC power from the power source and provide DC power to the power converter and the controller, wherein the power converter is a direct current (DC) to DC power converter and the drive signal is a pulse width modulated gate drive signal such that a duty cycle of the drive signal is proportion to the target current.

15. A method of providing power to a light source via a driver circuit, said method comprising:

receiving power at a power converter of the driver circuit;

providing power from the power converter to the light source as a function of a drive signal;

sensing a current of the light source via a controller of the driver circuit;

sensing a voltage of the light source via the controller;

determining, via the controller, a command current for the current of the light source, wherein the command current is one of a default current or a current indicated by a dimming circuit of the driver circuit;

determining, via the controller, a target current for the current of the light source as a function of the command current, the sensed current of the light source, and the sensed voltage of the light source; and providing the drive signal from the controller to the power converter as a function of the determined target current.

16. The method of claim 15, wherein the step of determining the target current comprises increasing the target current from zero to the command current at a default rate of increase.

17. The method of claim 15, further comprising:

providing a dimming level to the controller from the dimming circuit of the driver circuit; and receiving the dimming level from the dimming circuit at the controller; wherein determining the command current for the light source via the controller comprises:

determining the command current to be the default current when the controller is not receiving a dimming level from the dimming circuit; and determining the command current to be a current corresponding to the dimming level when the controller is receiving a dimming level from the dimming circuit.

18. The method of claim 15, wherein the step of determining the target current comprises:

determining when the sensed current of the light source is equal to the command current and the sensed voltage of the light source is below a minimum voltage of the driver circuit; and incrementally increasing the target current above the command current in response to determining that the sensed current of the light source is equal to the target current and that the sensed voltage of the light source is below a minimum voltage of the driver circuit until the sensed voltage of the light source is above the minimum voltage of the driver circuit or the sensed current of the light source reaches a maximum current of the driver circuit.

19. The method of claim 15, wherein:

the step of determining the target current comprises determining when the sensed current of the light source is equal to the target current and the sensed voltage of the light source is below a minimum voltage of the driver circuit, and increasing the target current above the command current in response to determining that the sensed current of the light source is equal to the target current and that the sensed voltage of the light source is below a minimum voltage of the driver circuit; and the method further comprises determining when the target current is equal to a maximum current of the driver circuit and the voltage of the light source is below a minimum voltage of the driver circuit, and reducing the target current to zero in response to determining that the target current is equal to a maximum current of the driver circuit and the voltage of the light source is below a minimum voltage of the driver circuit.

20. The method of claim 15, further comprising:

determining a fault condition as a function of the sensed voltage of the light source and the sensed current of the light source, wherein the fault condition is one of the sensed current of the light source is below a minimum current of the driver circuit and the voltage of the light source is at a maximum voltage of the driver circuit, the sensed current of the light source is at a maximum current of the driver circuit and the sensed voltage of the light source is below a minimum voltage of the driver circuit, the sensed current of the light source is at or above a shutdown current of the driver circuit, and the sensed voltage of the light source is at or above a shutdown voltage of the driver circuit; and reducing the target current to zero in response to determining the fault condition; and after reducing the target current to zero in response to determining the fault condition, periodically increasing the target current toward the command current at a reduced rate of increase, reducing the target current back to zero when a fault condition is detected.

* * * * *